US011329430B2

(12) United States Patent
Cheng et al.

(10) Patent No.: US 11,329,430 B2
(45) Date of Patent: May 10, 2022

(54) ELECTRICAL CONNECTION ASSEMBLY AND FLOATING CONNECTOR

(71) Applicant: STARCONN ELECTRONIC (Su Zhou) Co., LTD, Kunshan (CN)

(72) Inventors: heng-shan Cheng, Kunshan (CN); yan Xu, Kunshan (CN); Chung-Nan Pao, New Taipei (TW); Xuan-Hao Chen, New Taipei (TW)

(73) Assignee: STARCONN ELECTRONIC (Su Zhou) Co., LTD, Kunshan (CN)

( * ) Notice: Subject to any disclaimer, the term of this patent is extended or adjusted under 35 U.S.C. 154(b) by 0 days.

(21) Appl. No.: 17/030,382

(22) Filed: Sep. 24, 2020

(65) Prior Publication Data

US 2021/0376527 A1 Dec. 2, 2021

(30) Foreign Application Priority Data

May 29, 2020 (CN) ..... 202010477015.2

(51) Int. Cl.
*H01R 13/631* (2006.01)
*H01R 13/74* (2006.01)

(52) U.S. Cl.
CPC ..... *H01R 13/6315* (2013.01); *H01R 13/748* (2013.01)

(58) Field of Classification Search
CPC .. H01R 13/6315; H01R 13/621; H01R 13/74; H01R 13/748; H01R 13/5025; H01R 13/512
USPC ..... 439/362, 246–248
See application file for complete search history.

(56) References Cited

U.S. PATENT DOCUMENTS 4,580,862 A * 4/1986 Johnson ..... H01R 24/52 439/248
5,746,617 A * 5/1998 Porter, Jr. ..... H01R 13/6315 439/248
5,769,652 A * 6/1998 Wider ..... H01R 13/6315 439/248
6,179,637 B1 * 1/2001 Lee ..... H02B 11/12 439/248
7,056,144 B2 * 6/2006 Barsun ..... G06F 1/183 439/362
7,422,456 B1 * 9/2008 Mitani ..... H01R 13/6315 439/247
7,549,885 B1 * 6/2009 Oh ..... H01R 13/6215 439/247
8,231,399 B2 * 7/2012 Daubigney ..... H01R 13/6275 439/316

(Continued)

*Primary Examiner* — Marcus E Harcum
(74) *Attorney, Agent, or Firm* — Li & Cai Intellectual Property Office

(57) ABSTRACT

An electrical connection assembly and a floating connector are provided. The floating connector includes a floating module, a main body, and a plurality of elastic components. The floating module defines an active region therein, and the floating module has a plurality of thru-holes arranged outside of the active region. The main body is inserted into the active region of the floating module. The elastic components are disposed in the active region and are elastically deformable along an insertion direction. Two ends of each of the elastic components are respectively abutted against the floating module and the main body, so that the main body is movable along the insertion direction relative to the floating module through at least one of the elastic components.

13 Claims, 11 Drawing Sheets

(56) References Cited

U.S. PATENT DOCUMENTS

| | | | | |
|---|---|---|---|---|
| 8,357,000 | B1 * | 1/2013 | Albrecht | F41A 25/00 439/248 |
| 10,958,014 | B1 * | 3/2021 | Martin | H01R 13/6315 |
| 2002/0042218 | A1 * | 4/2002 | De Petris | H01L 23/3114 439/246 |
| 2002/0048982 | A1 * | 4/2002 | Gu | H01R 13/6315 439/247 |
| 2006/0073723 | A1 * | 4/2006 | Cowgill | H01R 13/6315 439/247 |
| 2012/0262888 | A1 * | 10/2012 | Liu | H01R 13/6315 361/752 |
| 2015/0071675 | A1 * | 3/2015 | Suzaki | G03G 15/80 399/90 |
| 2015/0333446 | A1 * | 11/2015 | Yuan | H01R 13/6315 439/248 |
| 2017/0257980 | A1 * | 9/2017 | Fukunaga | H01R 13/005 |

* cited by examiner

ELECTRICAL CONNECTION ASSEMBLY AND FLOATING CONNECTOR

CROSS-REFERENCE TO RELATED PATENT APPLICATION

This application claims the benefit of priority to China Patent Application No. 202010477015.2, filed on May 29, 2020 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to an electrical connection assembly and a floating connector.

BACKGROUND OF THE DISCLOSURE

A conventional floating connector can be used to absorb or decrease a deviation by making some components thereof to be slightly floatable. However, the conventional floating connector is difficult to be used to absorb or decrease a deviation that is generated when the conventional floating connector is inserted into a mating connector along an insertion direction, so that the conventional floating connector cannot be precisely inserted into a mating connector.

SUMMARY OF THE DISCLOSURE

In response to the above-referenced technical inadequacies, the present disclosure provides an electrical connection assembly and a floating connector to effectively improve on the issues associated with conventional floating connectors.

In one aspect, the present disclosure provides an electrical connection assembly for being assembled onto a panel. The electrical connection assembly includes a floating connector and an assembling module. The floating connector includes a floating module, a main body, and a plurality of elastic components. The floating module defines an active region. The floating module has a plurality of thru-holes arranged outside of the active region. The main body is inserted into the active region of the floating module. The elastic components are disposed in the active region and are elastically deformable along an insertion direction. Two ends of each of the elastic components are respectively abutted against the floating module and the main body, so that the main body is movable along the insertion direction relative to the floating module through at least one of the elastic components. The assembling module is abutted against the floating module by the thru-holes and configured to be fixed to the panel. In a plane perpendicular to the insertion direction, a portion of the assembling module arranged in any one of the thru-holes is spaced apart from an inner wall of the corresponding thru-hole by a distance, so that the floating module is movable along the plane relative to the assembling module.

In another aspect, the present disclosure provides a floating connector, which has a floating module, a main body, and a plurality of elastic components. The floating module defines an active region therein. The floating module has a plurality of thru-holes arranged outside of the active region. The main body is inserted into the active region of the floating module. The elastic components are disposed in the active region and elastically deformable along an insertion direction. Two ends of each of the elastic components are respectively abutted against the floating module and the main body, so that the main body is movable along the insertion direction relative to the floating module through at least one of the elastic components.

Therefore, the elastic components in the present disclosure are abutted against the floating module and the main body, so that the main body can be movable along the insertion direction relative to the floating module through at least one of the elastic components. Accordingly, the floating connector or the electrical connection assembly in the present disclosure can be precisely inserted into a mating connector.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
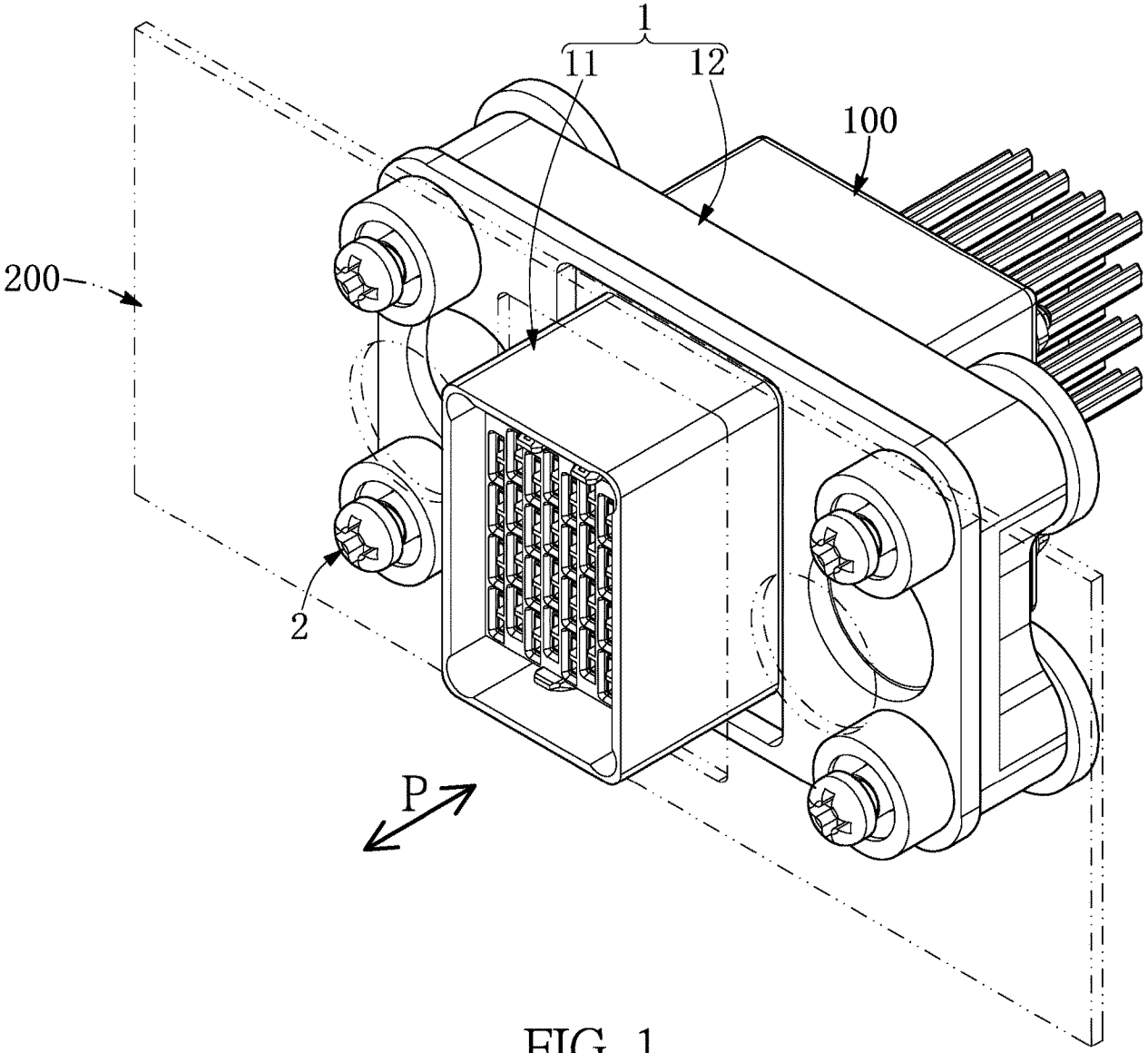
FIG. 1 is a perspective view of an electrical connection assembly according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
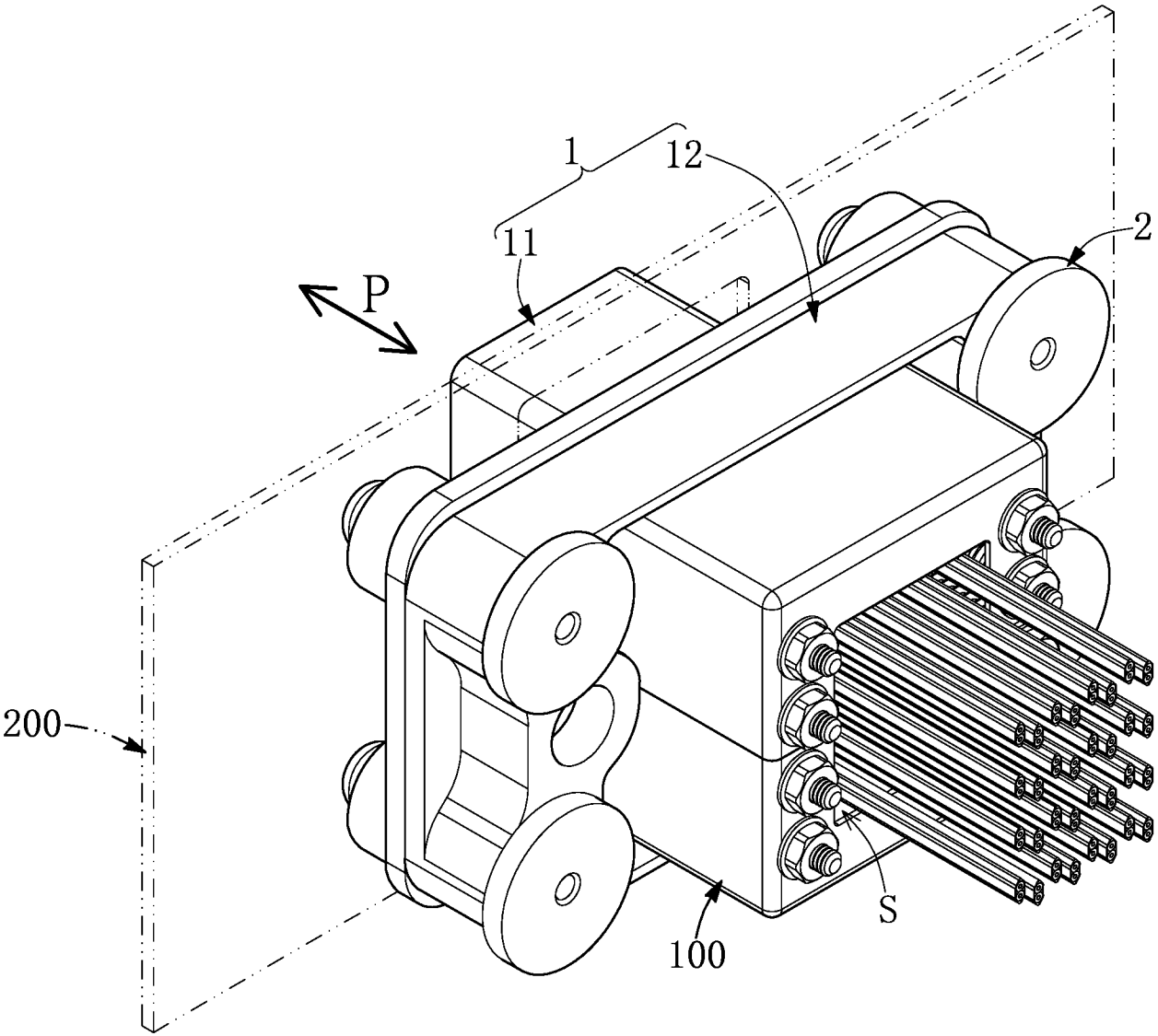
FIG. 2 is a perspective view of the electrical connection assembly from another angle of view according to the embodiment of the present disclosure.
Figure 3:
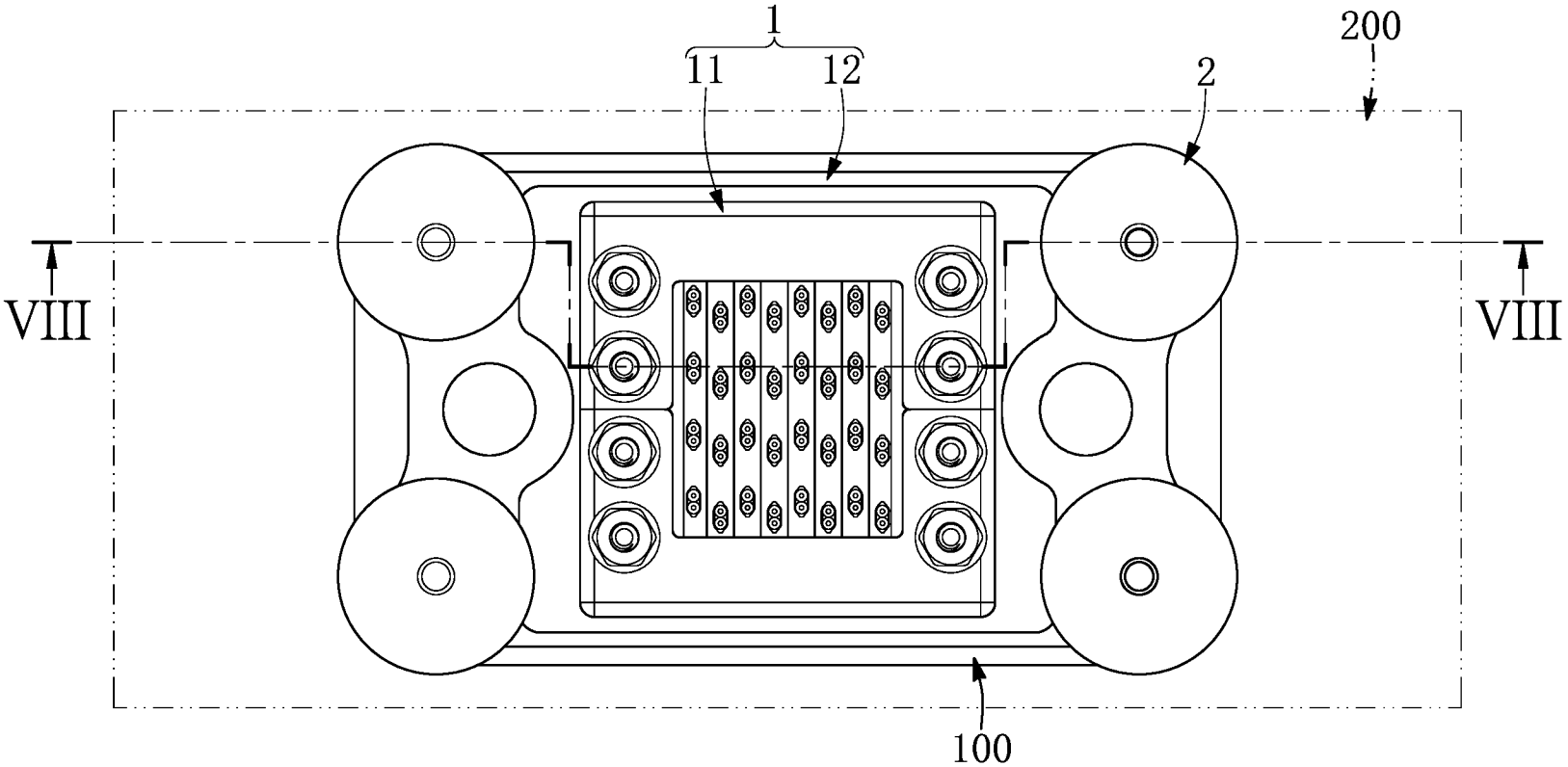
FIG. 3 is a rear view of FIG. 1.
Figure 4:
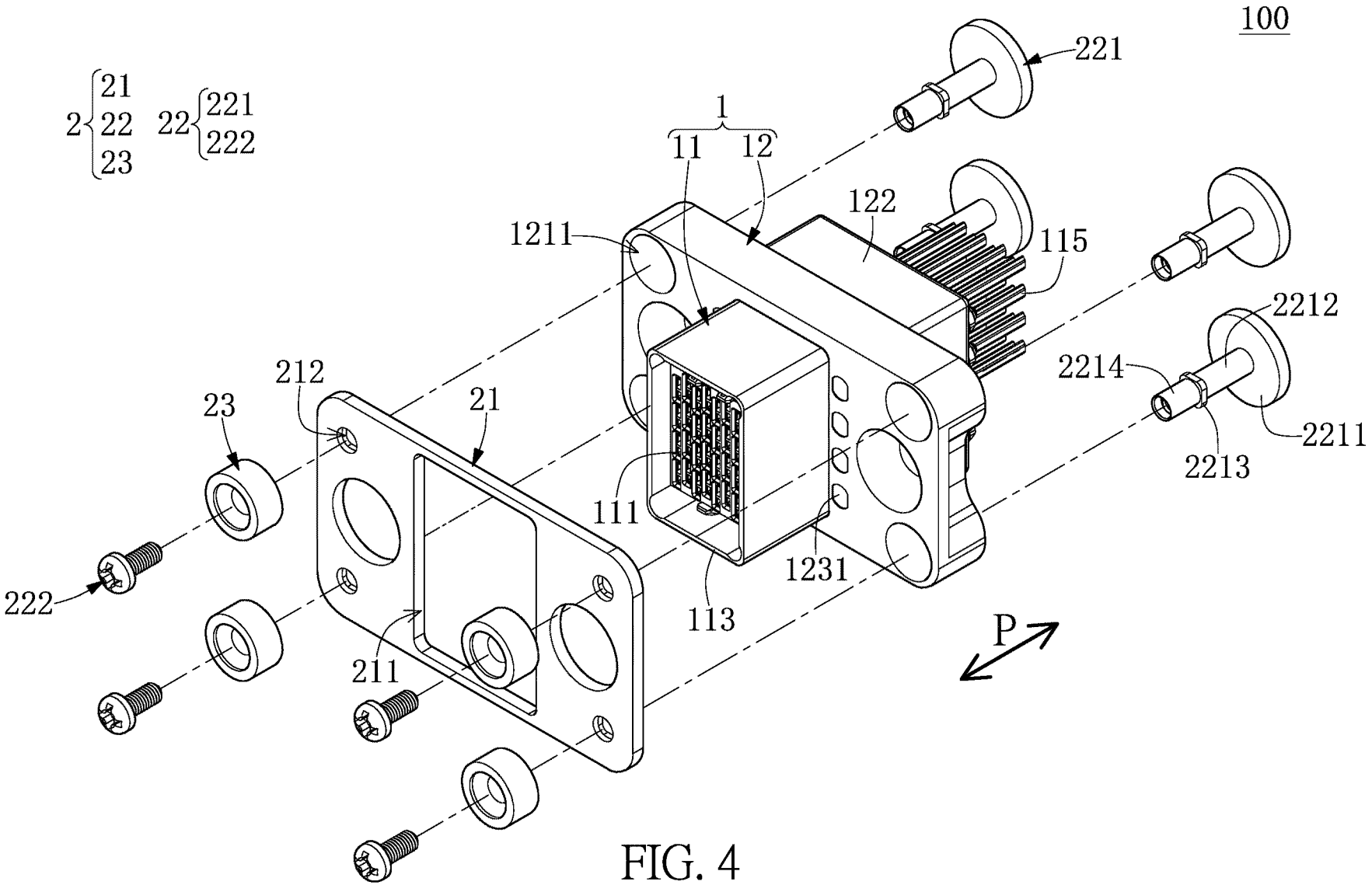
FIG. 4 is an exploded view of FIG. 1.
Figure 5:
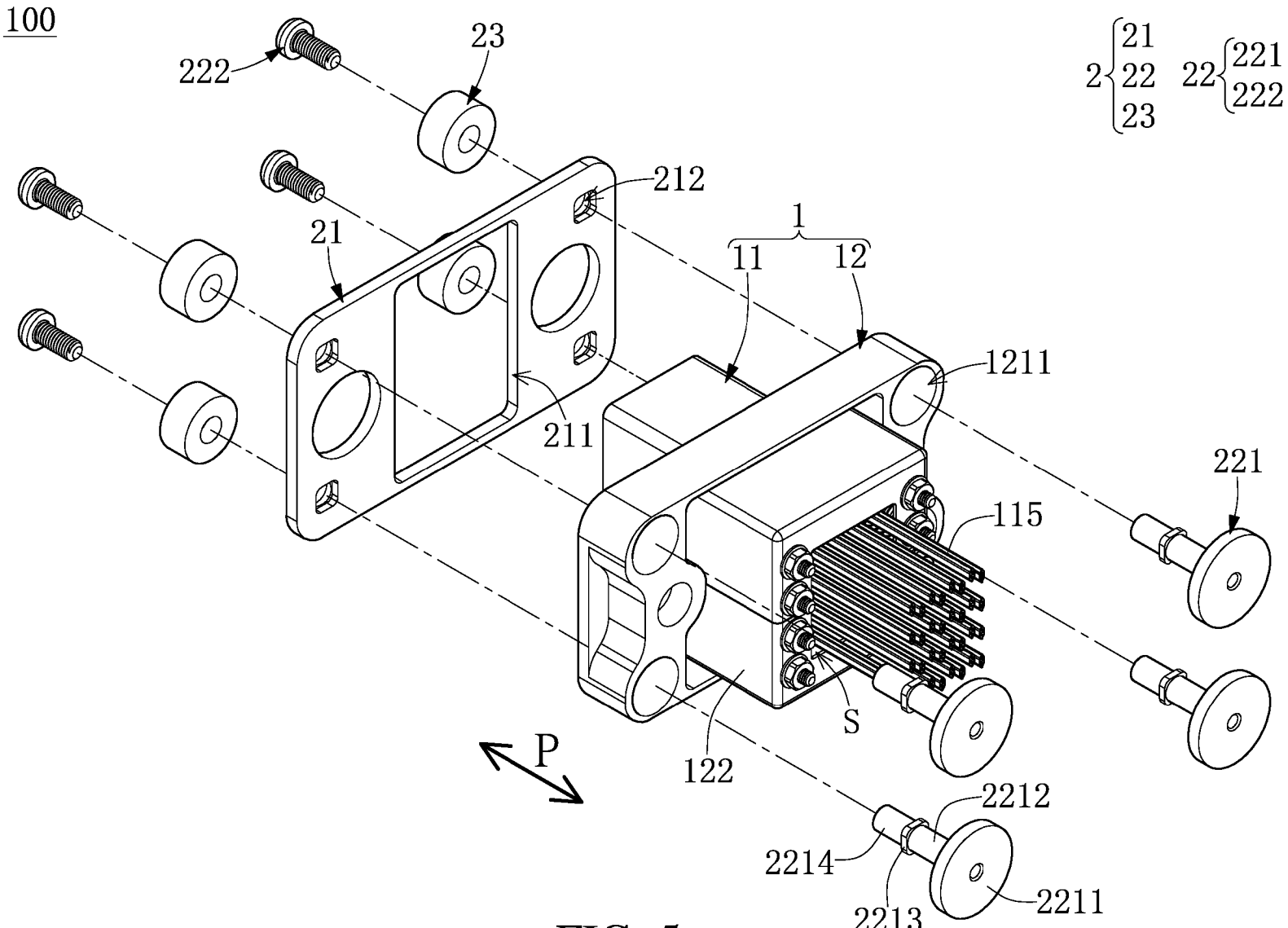
FIG. 5 is an exploded view of FIG. 2.

Referring to FIG. 1 to FIG. 10, an embodiment of the present disclosure provides an electrical connection assembly 100 for being assembled onto a panel 200 (shown in FIG. 1 to FIG. 3). As shown in FIG. 4 and FIG. 5, the electrical connection assembly 100 includes a floating connector 1 and an assembling module 2 that is configured to fix the floating connector 1 onto the panel 200. It should be noted that the floating connector 1 in the present embodiment is described in cooperation with the assembling module 2, but the present disclosure is not limited thereto. For example, in other embodiments of the present disclosure, the floating connector 1 can be independently used (e.g., sold) or can be used in cooperation with other components. The following description describes the structure and connection relationship of each component of the electrical connection assembly 100.

Figure 6:
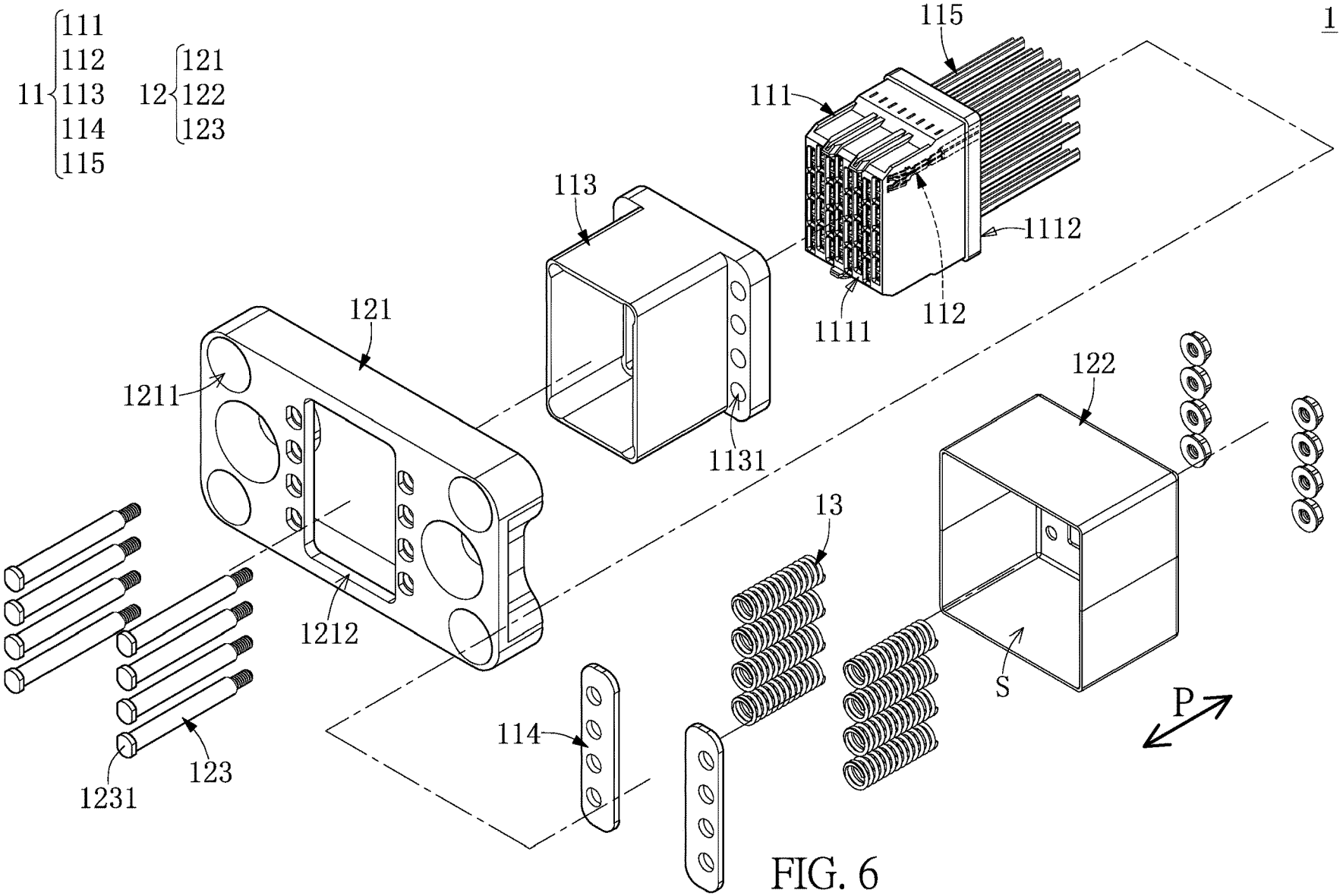
FIG. 6 is an exploded view of a floating connector shown in FIG. 4.
Figure 7:
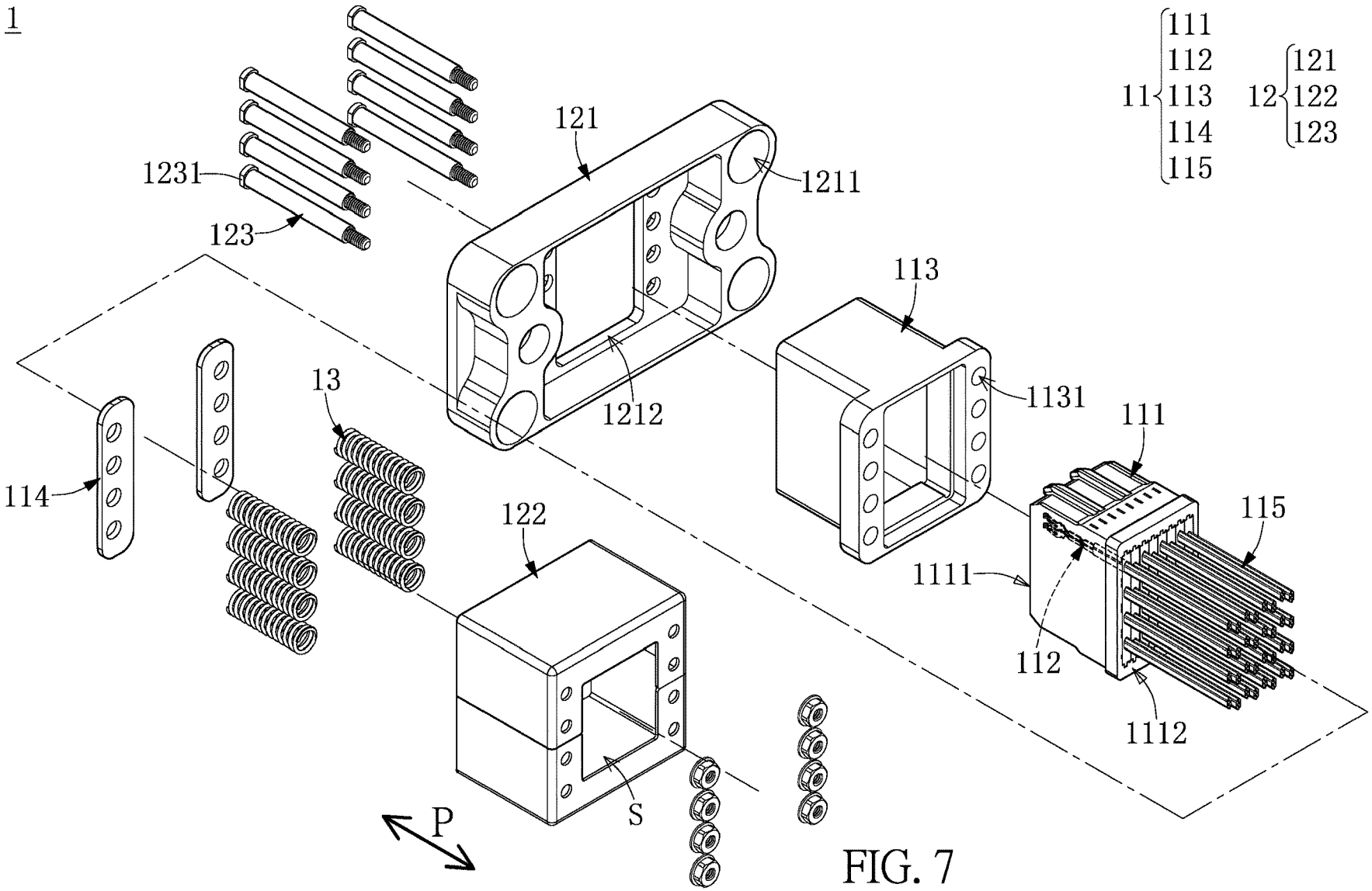
FIG. 7 is an exploded view of the floating connector shown in FIG. 5.
Figure 8:
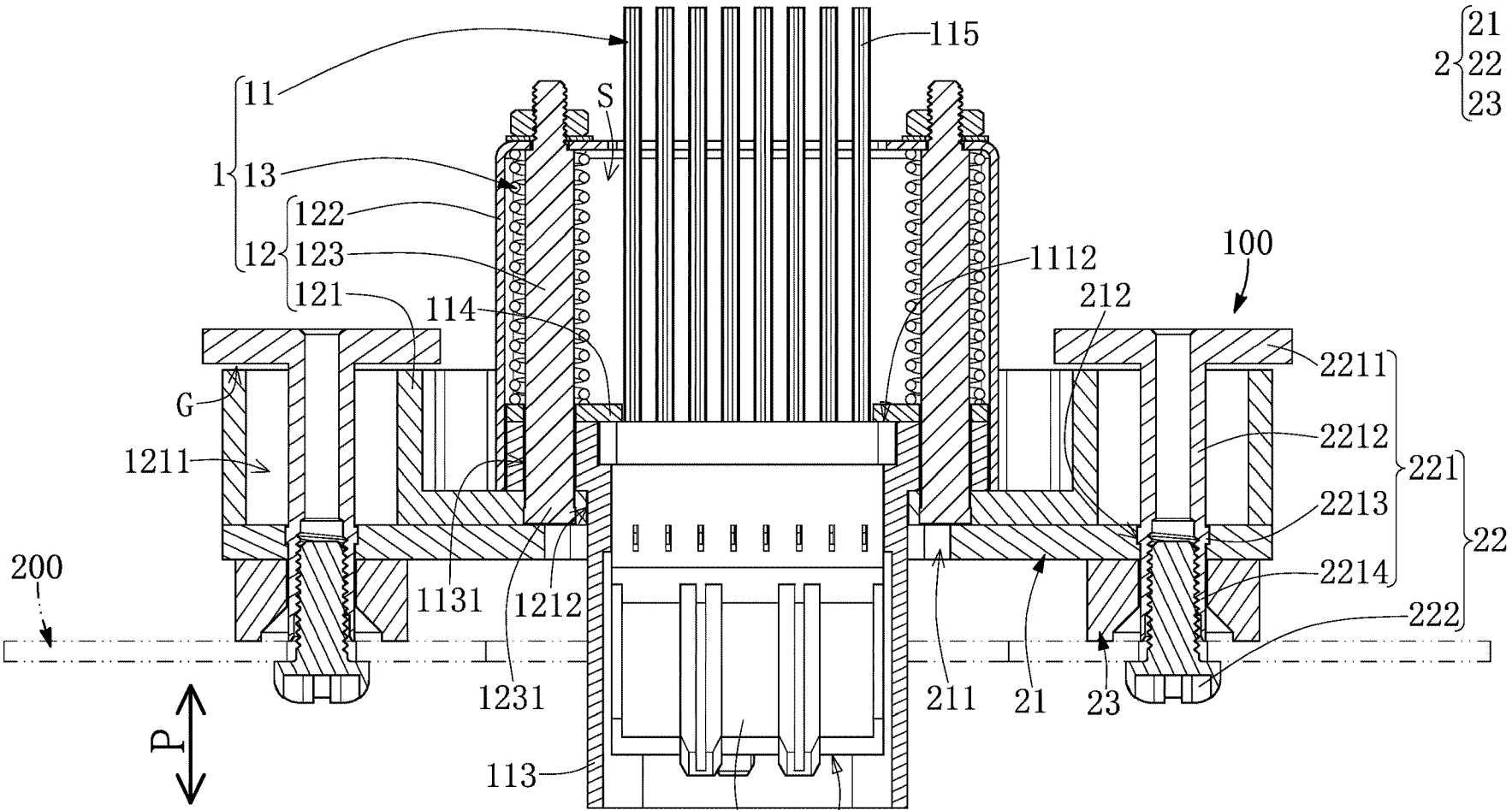
FIG. 8 is a cross-sectional view taken along line VIII-VIII of FIG. 3.

The floating connector 1 shown in FIG. 6 to FIG. 8 includes a main body 11, a floating module 12 assembled to the main body 11, and a plurality of elastic components 13 that are abutted against and arranged between the main body 11 and the floating module 12. Moreover, the main body 11 in the present embodiment is a high density cable connector, and each of the elastic components 13 is a compression spring. The mode of the main body 11 and the mode and quantity of the elastic components 13 can be adjusted or changed according to design requirements, and are not limited to the present embodiment.

In the present embodiment, the main body 11 includes an insulating housing 111, a plurality of conductive terminals 112 fastened to the insulating housing 111, a supporting housing 113 sleeved around an outer side of the insulating housing 111, two pressing boards 114 sandwiched between the supporting housing 113 and the elastic components 13, and a plurality of cables 115 that are respectively connected to the conductive terminals 112.

The insulating housing 111 has an insertion end 1111 and an assembling end 1112 that is opposite to the insertion end 1111. The conductive terminals 112 are inserted into the insulating housing 111. The supporting housing 113 covers the insulating housing 111, and the insertion end 1111 and the assembling end 1112 of the insulating housing 111 are arranged in the supporting housing 113, and the insertion end 1111 of the insulating housing 111 is configured to be connected to a mating connector (not shown in figures) along an insertion direction P. The assembling end 1112 of the insulating housing 111 is substantially coplanar with an adjacent surface of the supporting housing 113.

Moreover, the main body 11 has a plurality of perforation holes 1131 formed in the supporting housing 113. The perforation holes 1131 in the present embodiment are arranged in two rows that are respectively arranged on two opposite sides of the supporting housing 113 adjacent to the assembling end 1112. The two pressing boards 114 are abutted against the assembling end 1112 of the insulating housing 111 and the adjacent surface of the supporting housing 113 so as to fix the insulating housing 111 into the supporting housing 113. The two pressing boards 114 in the present embodiment are respectively disposed on two portions of the supporting housing 113 that respectively have the two rows of the perforation holes 1131, but the present disclosure is not limited thereto. In addition, the cables 115 are respectively connected to portions of the conductive terminals 112 adjacent to the assembling end 1112, and the cables 115 are exposed from the supporting housing 113 and are substantially located between the two pressing boards 114.

In other embodiments of the present disclosure, ends of the two pressing boards 114 can be connected to jointly form a ring-shaped structure, so that the quantity of the pressing board 114 of the main body 11 can be only one. In other words, the quantity of the pressing board 114 of the main body 11 can be at least one, and the at least one pressing board 114 is abutted against the insulating housing 111 so as to fix the insulating housing 111 into the supporting housing 113.

Figure 9:
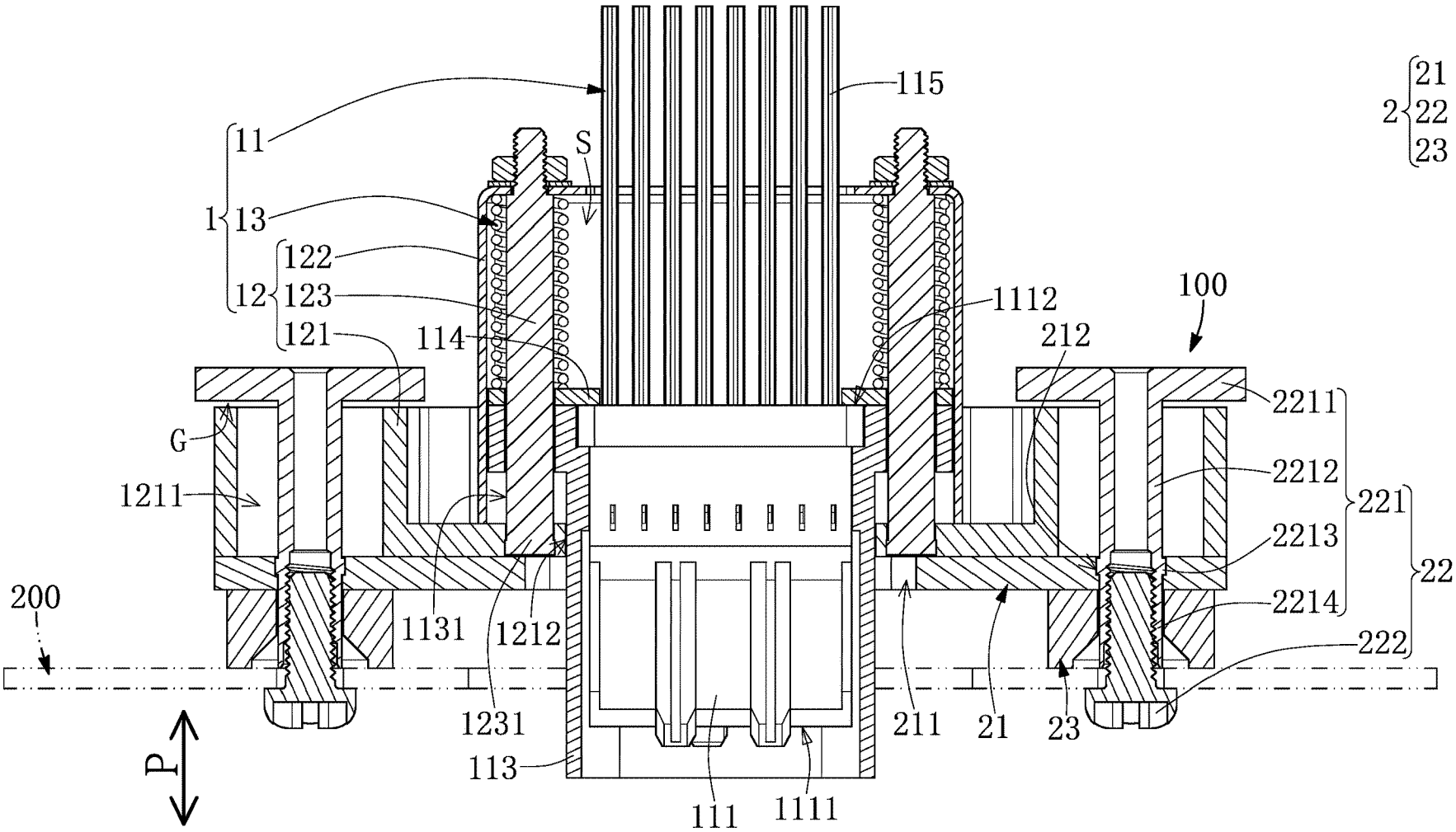
FIG. 9 is a cross-sectional view showing the electrical connection assembly of FIG. 8 when a main body of the floating connector is moved along an insertion direction.
Figure 10:
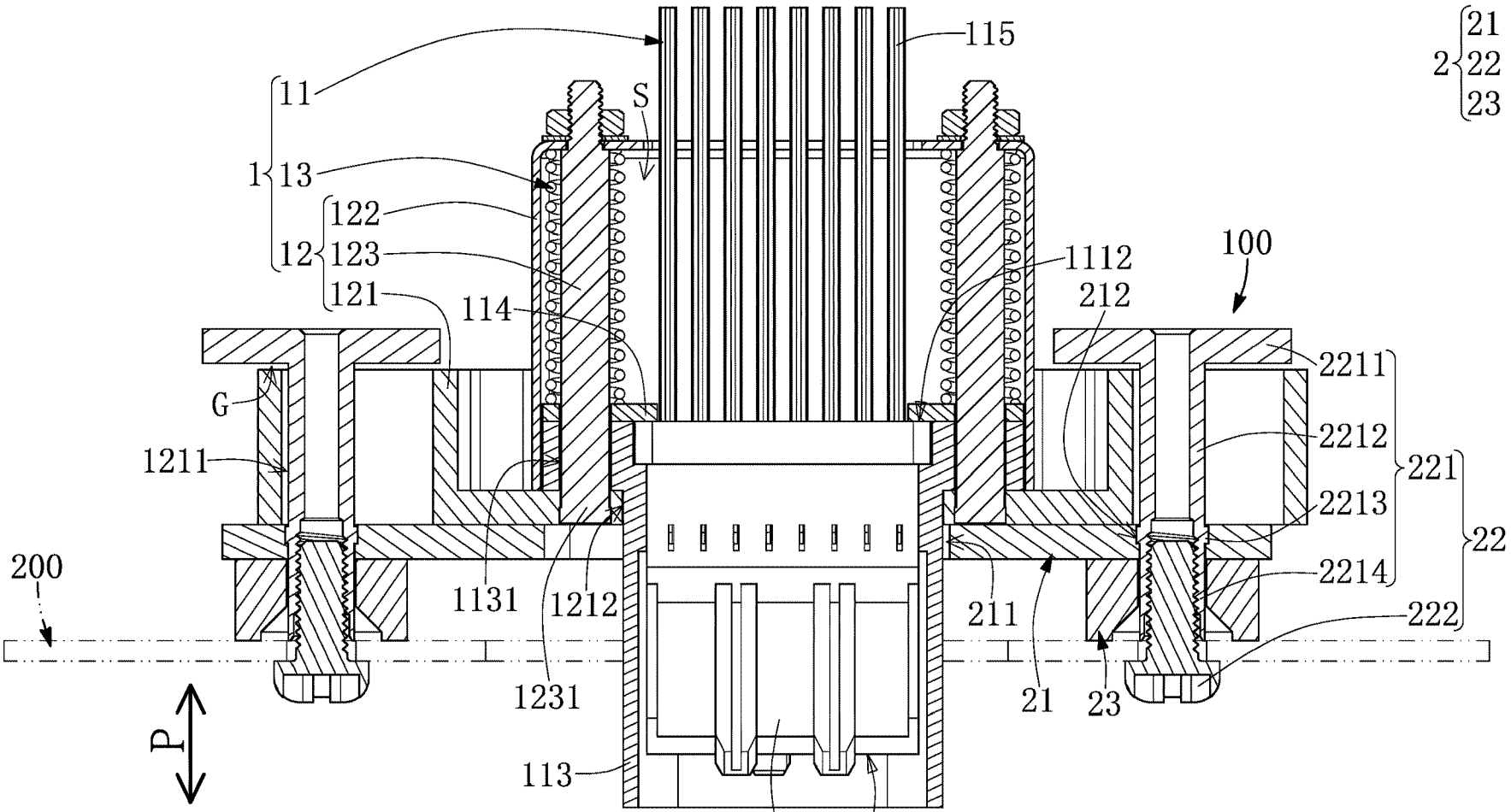
FIG. 10 is a cross-sectional view showing the electrical connection assembly of FIG. 8 when the floating connector is moved along a plane perpendicular to the insertion direction.

The floating module 12 defines an active region S and has a plurality of thru-holes 1211 arranged outside of the active region S. The main body 11 is inserted into the active region S of the floating module 12, and the elastic components 13 are disposed in the active region S and are elastically deformable along the insertion direction P, so that the elastic components 13 are configured to tend to maintain the main body 11 abutting against the floating housing 121. Specifically, as shown in FIG. 9, two ends of each of the elastic components 13 are respectively abutted against the floating module 12 and the main body 11, so that the main body 11 is movable along the insertion direction P relative to the floating module 12 through at least one of the elastic components 13.

Accordingly, the floating connector 1 in the present embodiment can be precisely inserted into the mating connector by having the elastic components 13 that are abutted against the floating module 12 and the main body 11 and by having the main body 11 that is movable along the insertion direction P relative to the floating module 12 through at least one of the elastic components 13.

It should be noted that the floating module 12 can be any structure satisfying the above features. In other words, the floating module 12 can be provided in many different structures. In order to describe the present embodiment, the following description describes the floating module 12 provided in one of the different structures, but the present disclosure is not limited thereto.

Figure 11:
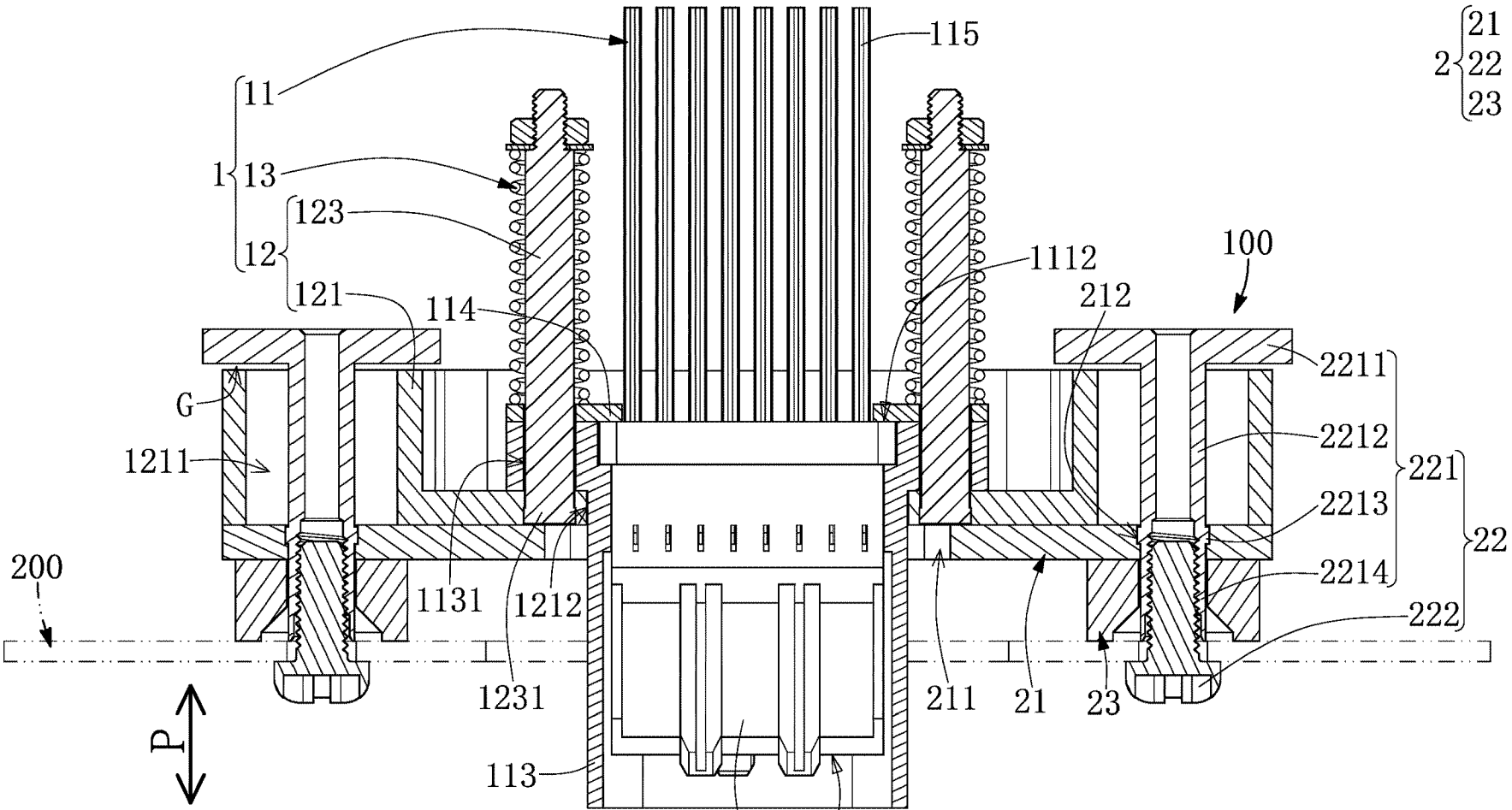
FIG. 11 is a cross-sectional view showing the electrical connection assembly in another configuration.

In the present embodiment, the floating module 12 includes a floating housing 121 formed with the thru-holes 1211, a trough 122 connected to the floating housing 121, and a plurality of guiding rods 123 that fix the floating housing 121 and the trough 122 (e.g., each of the guiding rods 123 has a screw rod and a screw nut that is used in cooperation with the screw rod) to each other. In the present embodiment, an interior space of the trough 122 defines the active region S through the floating housing 121, or a peripheral space around the guiding rods 123 defines the active region S through the floating housing 121, but the present disclosure is not limited thereto. For example, as shown in FIG. 11, the floating module 12 can include the floating housing 121 and the guiding rods 123 that are fixed to the floating housing 121, and the floating module 12 excludes the trough 122.

Specifically, the floating housing 121 in the present embodiment is in a substantially rectangular shape, each corner portion of the floating housing 121 has one of the thru-holes 1211, and a substantial center portion of the floating housing 121 has an accommodating hole 1212. The position of the trough 122 corresponds to that of the substantial center portion of the floating housing 121, and the active region S is in spatial communication with the accommodating hole 1212.

A portion of the main body 11 (e.g., the insertion end 1111 of the insulating housing 111 and adjacent parts of other components of the main body 11) protrudes from the accommodating hole 1212 of the floating housing 121 and does not contact an inner wall of the accommodating hole 1212, and another portion of the main body 11 (e.g., the assembling end 1112 of the insulating housing 111 and adjacent parts of other components of the main body 11) is arranged in the active region S of the floating module 12.

Specifically, a portion of the supporting housing 113 protrudes from the accommodating hole 1212 of the floating housing 121 and contacts or does not contact the inner wall of the accommodating hole 1212, and another portion of the supporting housing 113 (e.g., the perforation holes 1131) is arranged in the active region S of the floating module 12.

Moreover, the guiding rods 123 sequentially pass through the floating housing 121, the perforation holes 1131 of the supporting housing 113, the two pressing boards 114, the elastic components 13, and the trough 122 along the insertion direction P. End portions 1231 of the guiding rods 123 are respectively arranged in (or engaged with) and fixed to portions of the floating housing 121 that are respectively located at two opposite sides of the accommodating hole 1212. The guiding rods 123 respectively pass through the perforation holes 1131 of the supporting housing 113. The end portion 1231 of each of the guiding rods 123 is limited or retained by the floating housing 121, so that the end portion 1231 of each of the guiding rods 123 is not rotated relative to the corresponding perforation hole 1131.

In addition, the guiding rods 123 respectively pass through the elastic components 13 one to one along the insertion direction P, and the main body 11 is movably assembled to the guiding rods 123 along the insertion direction P. The two ends of each of the elastic components 13 are respectively abutted against the trough 122 and the corresponding pressing board 114 of the main body 11 so as to tend to maintain the supporting housing 113 of the main body 11 abutting against the floating housing 121. Therefore, the main body 11 is limited or retained by at least one of the floating housing 121, the guiding rods 123, and the trough 122. Moreover, the main body 11 is movable along the guiding rods 123, and the movement region of the main body 11 is substantially located between the floating housing 121 and the trough 122. In addition, as shown in FIG. 11, the movement region of the main body 11 is substantially located between the floating housing 121 and distal ends of the guiding rods 123 away from the floating housing 121. In other words, as shown in FIG. 11, the movement region of the main body 11 is substantially located between two opposite ends of each of the guiding rods 123, and the movement region of the main body 11 has a length in the insertion direction P that corresponds to the length of each of the guiding rods 123. In other words, the main body 11 is movable in the active region S along the insertion direction P by the elastic components 13 (shown in FIG. 8 to FIG. 9).

The assembling module 2 is abutted against the floating module 12 by the thru-holes 1211 and is configured to be fixed to the panel 200, thereby assembling the floating connector 1 onto the panel 200. In a plane perpendicular to the insertion direction P (shown in FIG. 10), a portion of the assembling module 2 (e.g., a main segment 2212 of a screw rod 221 disclosed in the following description) arranged in any one of the thru-holes 1211 is spaced apart from an inner wall of the corresponding thru-hole 1211 by a distance, so that the floating module 12 is movable along the plane relative to the assembling module 2. Moreover, the floating module 12 can be movable along a specific direction or any direction in the plane relative to the assembling module 2, but the present disclosure is not limited thereto.

Accordingly, by the cooperation between the floating connector 1 and assembling module 2 of the electrical connection assembly 100 in the present embodiment, the main body 11 of the floating connector 1 can be floated (or moved) along different directions to effectively improve (or absorb) a deviation generated from the floating connector 1, so that the floating connector 1 can be precisely inserted into the mating connector.

It should be noted that the assembling module 2 can be any structure satisfying the above features. In other words, the assembling module 2 can be provided in many different structures. In order to describe the present embodiment, the following description describes the assembling module 2 in one of the different structures that is only used in cooperation with the above floating module 12 of the present embodiment, but the present disclosure is not limited thereto.

In the present embodiment, as shown in FIG. 4 and FIG. 5, the assembling module 2 incudes a fixing board 21 substantially corresponding in contour to floating housing 121, a plurality of screwing components 22 assembled to the fixing board 21, and a plurality of washers 23 that are respectively sleeved around the screwing components 22.

As shown in FIG. 4 to FIG. 8, the fixing board 21 has an active hole 211 and a plurality of engagement holes 212 that are arranged outside of the active hole 211. The fixing board 21 is configured to be abutted against the floating housing 121 of the floating module 12, and covers one side of the thru-holes 1211 (e.g., one side of the thru-holes 1211 adjacent to the fixing board 21 or the bottom side of the thru-holes 1211 shown in FIG. 8) along the insertion direction P. In other words, the assembling module 2 is configured to block a surface of the end portion 1231 of each of the guiding rods 123 along the insertion direction P (through the fixing board 21), thereby firmly fixing the guiding rods 123 in position. Specifically, the active hole 211 of the fixing board 21 corresponds in position to the accommodating hole 1212 of the floating housing 121 along the insertion direction P, thereby providing a part of the main body 11 to be movably inserted therein. The engagement holes 212 respectively respond in position to the thru-holes 1211 along the insertion direction P.

The screwing components 22 respectively pass through the engagement holes 212 of the fixing board 21, the thru-holes 1211 of the floating housing 12 and cover another side of the thru-holes 1211 (e.g., one side of the thru-holes 1211 adjacent to the trough 122 or the top side of the thru-holes 1211 shown in FIG. 8) along the insertion direction P. Each of the washers 23 is configured to be sandwiched between the fixing board 21 and the panel 200 through the corresponding screwing component 22.

Any one of the screwing components 22 is assembled to the fixing board 21 through the corresponding thru-hole 1211 and the corresponding engagement hole 212. When the floating module 12 is abutted against the fixing board 21, any one of the screwing components 22 is spaced apart from the floating housing 121 of the floating module 12 along the insertion direction P by a gap G Accordingly, the floating module 12 can be smoothly moved along the plane relative to the assembling module 2. In other words, the gap G in the present embodiment is not configured to or is not sufficient to cause the floating module 12 moving along the insertion direction P relative to the assembling module 2.

Specifically, each of the screwing components 22 in the present embodiment includes a screw rod 221 and a screw nail 222 that is used in cooperation with the screw rod 221. As the screwing components 22 are of the same structure, the following description discloses the structure of just one of the screwing components 22 for the sake of brevity. However, in other embodiments of the present disclosure, the screwing components 22 can be of different structures.

The screw rod 221 has a limiting segment 2211 covering the corresponding thru-hole 1211 along the insertion direction P, a main segment 2212 arranged in the corresponding thru-hole 1211, a retaining segment 2213 engaged with the engagement hole 212 of the fixing board 21, and a tail segment 2214 that is inserted into the corresponding washer 23. The screw nail 222 is screwed to the tail segment 2214 of the screw rod 221. In other words, the screw nails 222 are screwed to the tail segment 2214 of the screw rod 221 along the insertion direction P so as to respectively be inserted into the engagement holes 212 of the fixing housing 21, and the screw nail 222 and the corresponding washer 23 are jointly configured to clamp the panel 200.

In conclusion, the elastic components in the present disclosure are abutted against the floating module and the main body, so that the main body can be movable along the insertion direction relative to the floating module through at least one of the elastic components. Accordingly, the floating connector or the electrical connection assembly in the present disclosure can be precisely inserted into a mating connector.

Moreover, by the cooperation between the floating connector and assembling module of the electrical connection assembly in the present disclosure, the main body of the floating connector can be floated (or moved) along different directions to effectively improve (or absorb) a deviation generated from the floating connector, so that the floating connector can be precisely inserted into the mating connector.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electrical connection assembly for being assembled onto a panel, comprising:

a floating connector including:

a floating module defining an active region, wherein the floating module has a plurality of thru-holes arranged outside of the active region;

a main body inserted into the active region of the floating module; and a plurality of elastic components disposed in the active region and elastically deformable along an insertion direction, wherein two ends of each of the elastic components are respectively abutted against the floating module and the main body, so that the main body is movable along the insertion direction relative to the floating module through at least one of the elastic components; and an assembling module abutted against the floating module by the thru-holes and configured to be fixed to the panel, wherein in a plane perpendicular to the insertion direction, a portion of the assembling module arranged in any one of the thru-holes is spaced apart from an inner wall of the corresponding thru-hole by a distance, so that the floating module is movable along the plane relative to the assembling module.

2. The electrical connection assembly according to claim 1, wherein the floating module includes a floating housing having the thru-holes and a trough that is connected to the floating housing, and an interior space of the trough defines the active region through the floating housing, and wherein the two ends of each of the elastic components are respectively abutted against the trough and the main body so as to tend to maintain the main body abutting against the floating housing.

3. The electrical connection assembly according to claim 2, wherein the floating module includes a plurality of guiding rods fixing the floating housing and the trough to each other, and wherein the guiding rods respectively pass through the elastic components along the insertion direction, and the main body is movably assembled to the guiding rods along the insertion direction.

4. The electrical connection assembly according to claim 1, wherein the floating module includes a floating housing formed with the thru-holes and a plurality of guiding rods that are fixed to the floating housing, and a peripheral space around the guiding rods defines the active region through the floating housing, and wherein the guiding rods respectively pass through the elastic components along the insertion direction, the main body is movably assembled to the guiding rods along the insertion direction, and the elastic components are configured to tend to maintain the main body abutting against the floating housing.

5. The electrical connection assembly according to claim 4, wherein the main body has a plurality of perforation holes, an end portion of each of the guiding rods is arranged in and fixed to the floating housing, the guiding rods respectively pass through the perforation holes, and the end portion of each of the guiding rods is not rotated relative to the corresponding perforation hole, and wherein the assembling module is configured to block a surface of the end portion of each of the guiding rods along the insertion direction.

6. The electrical connection assembly according to claim 1, wherein the assembling module includes:

a fixing board configured to be abutted against the floating module, wherein the fixing board covers one side of the thru-holes along the insertion direction; and a plurality of screwing components respectively passing through thru-holes and covering another side of the thru-holes along the insertion direction, wherein any one of the screwing components is assembled to the fixing board through the corresponding thru-hole, and wherein when the floating module is abutted against the fixing board, any one of the screwing components is spaced apart from the floating module along the insertion direction by a gap.

7. The electrical connection assembly according to claim 6, wherein the floating module is configured to be smoothly moved along the plane relative to the assembling module by the gap.

8. The electrical connection assembly according to claim 6, wherein the assembling module includes a plurality of washers respectively sleeved around the screwing components, and wherein each of the washers is configured to be sandwiched between the fixing board and the panel through the corresponding screwing component.

9. The electrical connection assembly according to claim 8, wherein each of the screwing components includes:

a screw rod having a limiting segment covering the corresponding thru-hole along the insertion direction, a main segment arranged in the corresponding thru-hole, a retaining segment engaged with the fixing board, and a tail segment that is inserted into the corresponding washer; and a screw nail screwed to the tail segment of the screw rod, wherein the screw nail and the corresponding washer are jointly configured to clamp the panel.

10. The electrical connection assembly according to claim 1, wherein the floating module includes a floating housing, a substantial center portion of the floating housing has an accommodating hole, and the assembling module includes a fixing board configured to be abutted against the floating module, wherein the fixing board has an active hole that corresponds in position to the accommodating hole, and wherein a part of the main body is movably inserted into the active hole and the accommodating hole along the insertion direction.

11. The electrical connection assembly according to claim 1, wherein the main body includes an insulating housing, a plurality of conductive terminals fastened to the insulating housing, a supporting housing sleeved around an outer side of the insulating housing, and at least one pressing board that is sandwiched between the supporting housing and the elastic components, and wherein the at least one pressing board is abutted against the insulating housing so as to fix the insulating housing into the supporting housing.

12. A floating connector, comprising:

a floating module defining an active region therein, wherein the floating module has a plurality of thru-holes arranged outside of the active region;

a main body including an insulating housing, a plurality of conductive terminals fastened to the insulating housing, and a supporting housing that is sleeved around an outer side of the insulating housing, wherein the main body is inserted into the active region of the floating module; and a plurality of elastic components disposed in the active region and elastically deformable along an insertion direction, wherein two ends of each of the elastic components are respectively abutted against the floating module and the main body, so that the main body is movable along the insertion direction relative to the floating module through at least one of the elastic components.

13. A floating connector, comprising:

a floating module including a floating housing and a plurality of guiding rods that are fixed to the floating housing, wherein a peripheral space around the guiding rods defines an active region through the floating housing, and the floating housing has a plurality of thru-holes that are arranged outside of the active region;

a main body inserted into the active region of the floating module and movably assembled to the guiding rods along an insertion direction; and a plurality of elastic components disposed in the active region, wherein the guiding rods respectively pass through the elastic components along the insertion direction, and the elastic components are elastically deformable along the insertion direction, wherein two ends of each of the elastic components are respectively abutted against the floating module and the main body, and the elastic components are configured to tend to maintain the main body abutting against the floating housing, so that the main body is movable along the insertion direction relative to the floating module through at least one of the elastic components.

* * * * *